US009475637B2

(12) United States Patent
Perumal et al.

(10) Patent No.: US 9,475,637 B2
(45) Date of Patent: Oct. 25, 2016

(54) PACKAGED ASSEMBLY FOR MACHINE IMPLEMENT

(71) Applicant: Caterpillar Inc., Peoria, IL (US)

(72) Inventors: Parthasarathy Perumal, Hosur (IN); G. Sasikumar, Bangalore (IN); Arun Pethaperumal, Thirumayam (IN); Leo Varghese, Calicut (IN)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 14/813,143

(22) Filed: Jul. 30, 2015

(65) Prior Publication Data

US 2015/0328795 A1 Nov. 19, 2015

(51) Int. Cl.

| | |
|---|---|
| ***B65D 85/68*** | (2006.01) |
| ***B26D 7/26*** | (2006.01) |
| ***B65D 85/00*** | (2006.01) |
| ***B65D 19/00*** | (2006.01) |

(52) U.S. Cl.

CPC ..... *B65D 85/68* (2013.01); *B26D 7/2614* (2013.01); *B65D 19/0004* (2013.01); *B65D 85/70* (2013.01); *B65D 2585/6875* (2013.01)

(58) Field of Classification Search

CPC .. B65D 85/68; B65D 19/0004; B65D 85/70; B65D 2585/6875; B26D 7/2614

USPC ..... 220/1.5; 206/386, 597, 595, 596, 599

See application file for complete search history.

(56) References Cited

U.S. PATENT DOCUMENTS

| | | | | | |
|---|---|---|---|---|---|
| 2,477,512 | A * | 7/1949 | Dunneback | B65D 85/00 | 206/319 |
| 2,488,368 | A * | 11/1949 | Bickham | B65D 85/68 | 206/317 |
| 2,660,295 | A * | 11/1953 | Beck | B65D 81/07 | 206/319 |
| 2,954,140 | A * | 9/1960 | Sutherland | B65D 85/68 | 206/585 |
| 3,561,621 | A * | 2/1971 | Rivers, Jr. | B60P 1/00 | 220/1.5 |
| 4,792,043 | A * | 12/1988 | Holladay | B65D 5/5035 | 206/335 |
| 5,364,226 | A * | 11/1994 | Gombos | A01F 15/005 | 414/343 |
| 5,495,937 | A * | 3/1996 | Fraser | B65D 5/5035 | 206/320 |
| 5,676,248 | A * | 10/1997 | Brazell | B65D 5/5007 | 206/319 |
| 7,011,223 | B1 * | 3/2006 | Grigsby, Sr. | B65D 19/385 | 108/56.1 |
| 7,350,662 | B2 * | 4/2008 | Arnold | B65D 19/18 | 206/335 |
| 7,387,215 | B1 * | 6/2008 | Grigsby, Sr. | B65D 19/385 | 108/56.1 |
| 7,413,077 | B2 * | 8/2008 | Rydberg | B63H 20/02 | 206/319 |
| 7,458,461 | B2 * | 12/2008 | Hara | B65D 19/44 | 206/319 |
| 7,762,416 | B2 * | 7/2010 | Arnold | B65D 19/18 | 220/1.5 |
| 7,762,417 | B2 * | 7/2010 | Arnold | B65D 19/18 | 206/335 |
| 2004/0232021 | A1 * | 11/2004 | Linton | B65D 85/68 | 206/335 |
| 2008/0041745 | A1 * | 2/2008 | Arnold | B65D 19/18 | 206/335 |

FOREIGN PATENT DOCUMENTS

| | | |
|---|---|---|
| JP | 8208196 | 8/1996 |
| JP | 9124158 | 5/1997 |
| JP | 2003165697 | 6/2003 |

* cited by examiner

*Primary Examiner* — King M Chu

(57) ABSTRACT

A packaged assembly for a work implement is provided. The packaged assembly includes a blade assembly, a brace assembly, a push arm assembly, a pair of support member, and plurality of separator blocks. The packaged assembly is bundled in a manner such that the packaged assembly lies in a horizontal orientation. The packaged assembly is configured to cooperate and interact with a fork lift, such that the fork lift performs loading and unloading operations of the packaged assembly without re-orienting the packaged assembly.

1 Claim, 3 Drawing Sheets

PACKAGED ASSEMBLY FOR MACHINE IMPLEMENT

TECHNICAL FIELD

The present disclosure relates to a handling, storing and transportation of a work implement of a machine, and more particularly to a packaged assembly associated with the work implement.

BACKGROUND

Machines such as track type tractors, motor graders, wheel loaders, excavators, backhoes, and other such machines include implements for perform various operations. These implements include, for example, buckets, compactors, fork assemblies, rippers, blades, and so on. The implement, for example a blade and push arm assembly, needs to be packaged for transportation and/or storage purposes and shipped to customer end as shiploose part. These implements will then be installed on the machine at customer location.

In case of the blade and push arm assembly, the blade and push arm assembly is collectively stored in an open top container. A top lid of the container is lifted using a crane, and simultaneously a front door of the container is also opened. The blade and push arm assembly are individually unloaded from the container, such that the blade first followed and then by push arms are lifted from a top opening of the container using the crane Further, the blade is then re-oriented to a stable position for storage of the blade and the push arm in a storage yard. As a result, the transportation, handling and storage of the blade and push arm assembly is a laborious, labor intensive, time consuming process requiring additional handling cost, space for re-orienting and storage purposes.

U.S. Pat. No. 3,561,621, hereinafter the '621 patent, describes A transport vehicle having a load bed with upstanding guides. The upstanding guides define container positions on the bed, and containers having downwardly converging pallet bottoms for automatic orienting at the container positions. The transport vehicle has an after deck that carries a load-handling machine for loading and unloading containers. The transport vehicle also includes a pivoted machine loading ramp pivotally mounted on the after deck and movable to and from loading position by the load-handling machine. However, the '621 patent does not describe an improved packaged design for the implement of the machine.

SUMMARY OF THE DISCLOSURE

In one aspect of the present disclosure, a packaged assembly for a work implement is provided. The packaged assembly includes a blade assembly. The blade assembly includes a brace assembly, a blade and a frame member where the frame member has a pair of side plates. The packaged assembly includes a push arm assembly that includes a plurality of push arms. The package assembly also includes a pair of support members coupled to the pair of side plates of the blade assembly. Further, one of the pair of support members includes a plurality of gliding elements attached thereto. The plurality of gliding elements is configured to slide the blade assembly along a work surface. The blade assembly is arranged in a manner such that the blade of the blade assembly faces the work surface. The packaged assembly further includes a plurality of separator blocks provided in a laterally spaced part arrangement on an outer surface of the frame member of the blade assembly, the plurality of separator blocks positioned in a contacting relationship with the outer surface. Further, a top surface of each of the plurality of separator blocks includes a plurality of depressions formed thereon. The plurality of push arms of the push arm assembly is received into the plurality of depressions of the plurality of separator blocks, such that the plurality of push arms is arranged perpendicular to the plurality of separator blocks. Further, the packaged assembly is bundled in a manner such that the packaged assembly lies in a horizontal orientation. The packaged assembly is configured to cooperate and interact with a fork lift, such that the fork lift performs loading and unloading operations of the packaged assembly without re-orienting the packaged assembly.

Other features and aspects of this disclosure will be apparent from the following description and the accompanying drawings.

DETAILED DESCRIPTION

Figure 1:
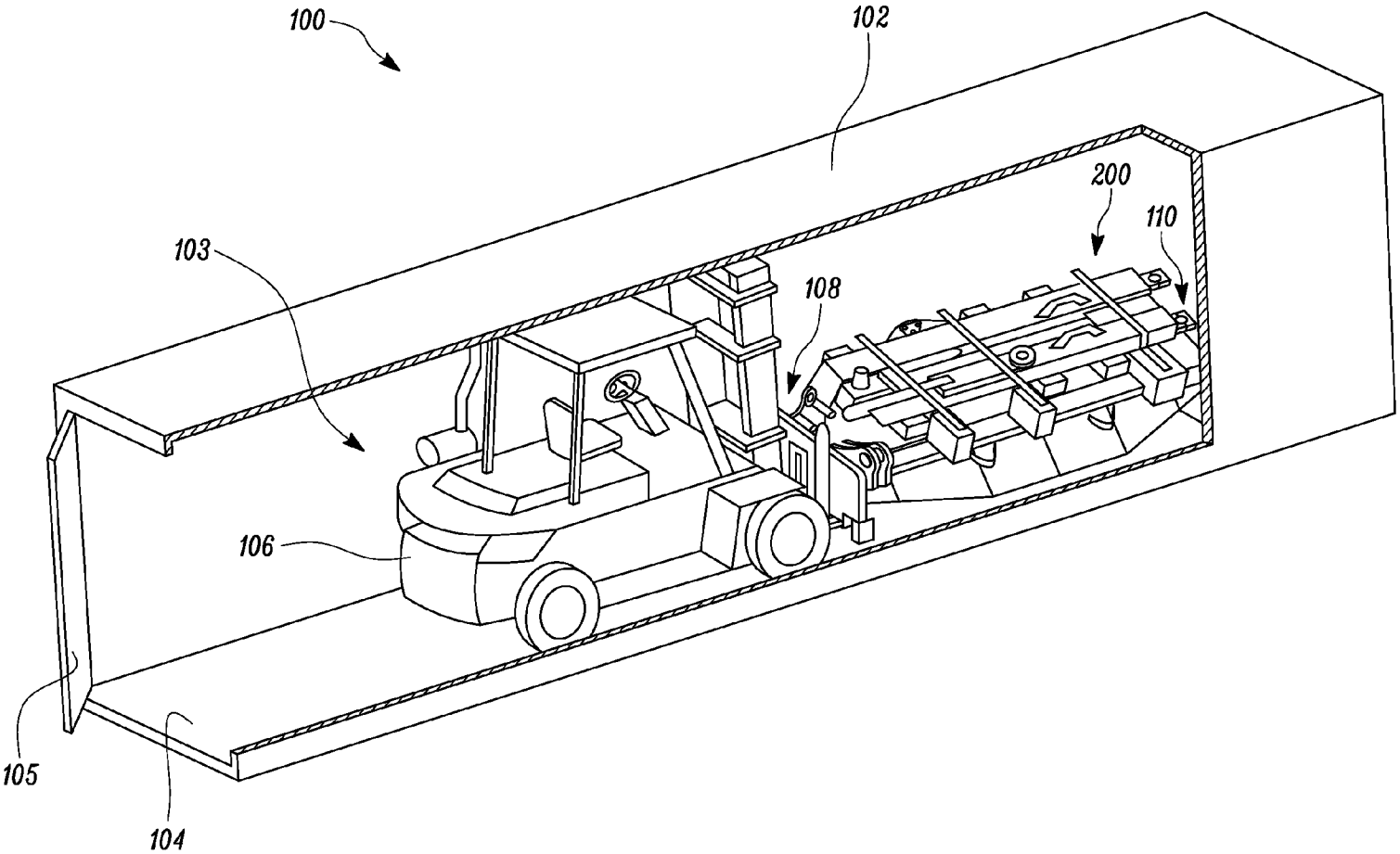
FIG. 1 is a partial cutaway perspective view of an exemplary container, a fork lift and a packaged assembly, according to one embodiment of the present disclosure.

Wherever possible, the same reference numbers will be used throughout the drawings to refer to the same or the like parts. Referring to FIG. 1, a portion of an exemplary storage system 100 including a container 102 is illustrated. The container 102 is used to store and transport objects from one location to another. The container 102 includes a work surface 104 for resting the object thereon. An inner space 103 of the container 102 is accessed through a door 105 of the container 102. The container 102 shown in the accompanying drawings is exemplary and does not limit the scope of the present disclosure. Further, dimensions of the container 102 may vary based on the application.

The present disclosure relates to a packaged assembly 200. The packaged assembly 200 is oriented horizontally with respect to the work surface 104 of the container 102. The packaged assembly 200 is associated with a work implement of a machine, and includes a blade assembly 202, a brace assembly 203 and a push arm assembly 204 (see FIG. 2). The packaged assembly 200 is bundled in such a manner that the work implement may be loaded and unloaded from the container 102 without requiring any re-orientation thereof. The packaged assembly 200 will be described in detail in connection with FIGS. 2 and 3. Although a single packaged assembly 200 is shown in FIG. 1, in actuality, the container 102 may include additional number of similar packaged assemblies that are not illustrated in the accompanying figures.

A fork lift 106 accesses the inner space 103 of the container 102 through the door 105. During loading or unloading operations of the packaged assembly 200 relative to the fork lift 106, the fork lift 106 cooperates and interacts with the packaged assembly 200 such that the packaged assembly 200 continues to remain in the horizontal orientation. The fork lift 106 is used to lift, transit, and unload the packaged assembly 200 from the container 102 to a desired location.

Figure 2:
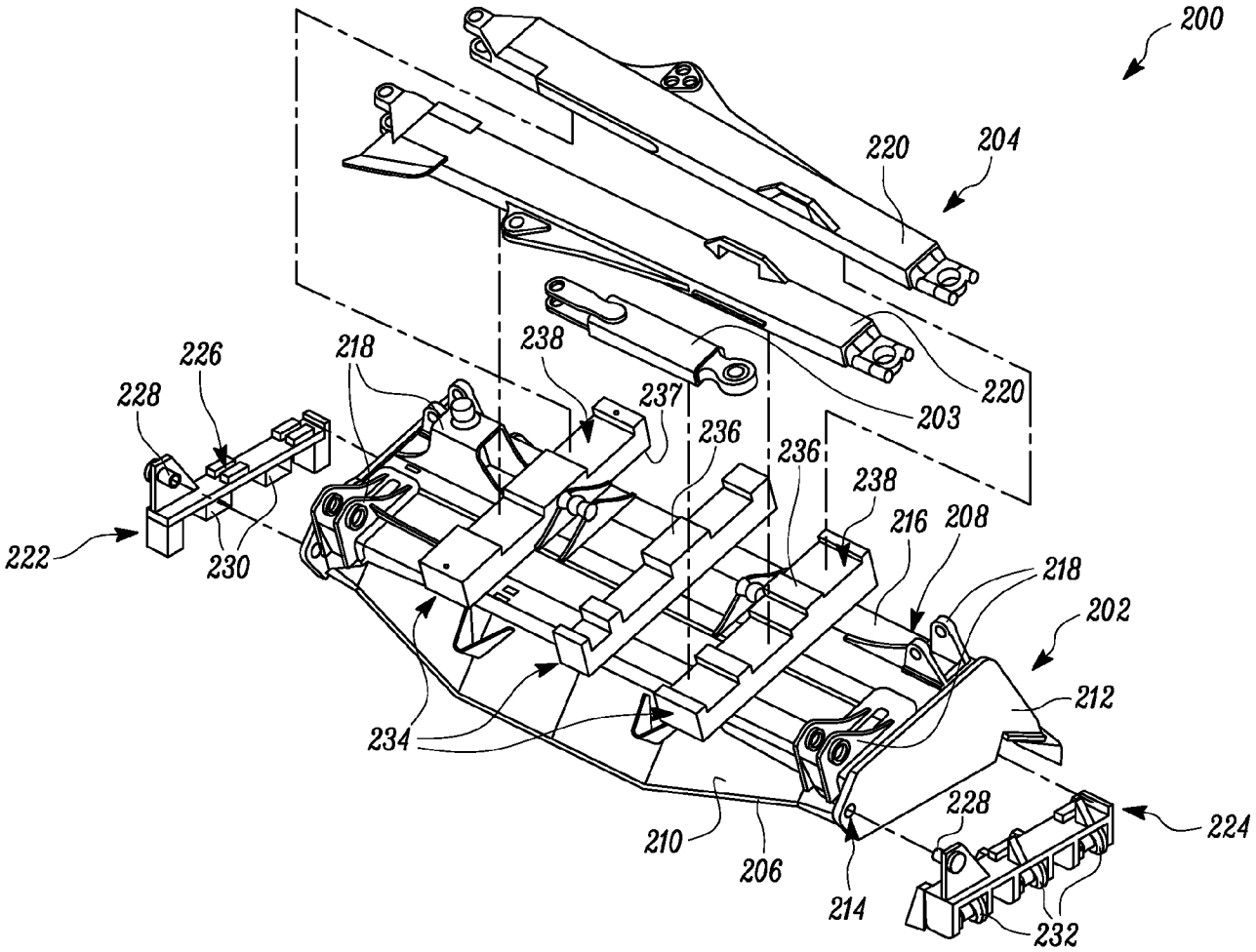
FIG. 2 is an exploded view of the packaged assembly of FIG. 1, according to one embodiment of the present disclosure.
Figure 3:
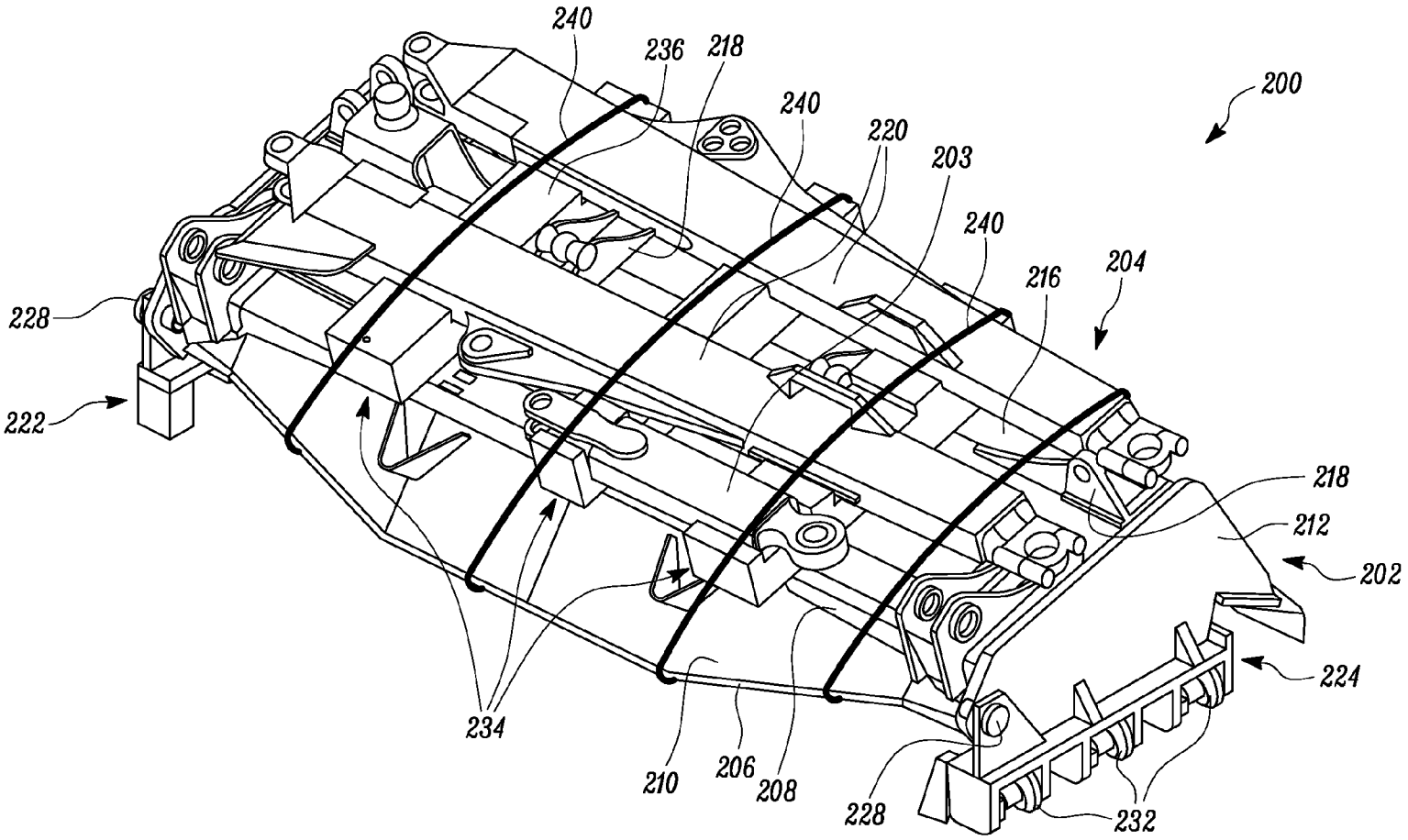
FIG. 3 is a bundled arrangement of the packaged assembly of FIG. 2, according to one embodiment of the present disclosure.

Referring to FIGS. 2 and 3, the packaged assembly 200 includes the blade assembly 202, the brace assembly 203 and the push arm assembly 204. The blade assembly 202 includes a blade 206 and a frame member 208. The blade 206 is configured to receive or engage, dig material such as rock, gravel or any other suitable material. The blade 206 is made up of a rigid material such as, cast iron, steel or any other suitable material. In the packaged assembly 200, the blade 206 is positioned in such a manner that a front surface of the blade 206 faces the work surface 104 (see FIG. 1). The frame member 208 is coupled to a rear side 210 of the blade 206 by welding, fastening, riveting, or by other fixed or removable connecting means.

The frame member 208 is configured to support the blade 206. The frame member 208 includes a pair of side plates 212. The side plates 212 may be made of rigid materials such as, cast iron, steel or any other suitable material. The frame member 208 has an outer surface 216. The outer surface 216 mounts multiple brackets 218 extending away from the frame member 208. The brackets 218 are configured to couple the blade assembly 202 with associated actuation members. The push arm assembly 204 includes a number of push arms 220. The push arms 220 are rigid links configured to rigidly or movably couple the blade assembly 202 with the machine.

The packaged assembly 200 includes the blade assembly 202, the brace assembly 203, the push arm assembly 204, a pair of support members 222, 224, and a number of separator blocks 234, bundled together to form a single package. The support members 222, 224 may be made of rigid materials such as, cast iron, steel or any other suitable material. The support members 222 are removably coupled to the side plates 212 of the blade assembly 202. Accordingly, the support members 222, 224 include multiple indents 226 for receiving the side plates 212. Additionally, the support members 222 are fixedly coupled to the side plates 212 by receiving pins 228 through corresponding holes 214 provided on the side plates 212. In alternate embodiments, any other mechanical fastener may be utilized for the coupling.

One of the support members 222 configured to be positioned at a proximal end 108 (see FIG. 1) to the fork lift 106 includes a pair of bracket members 230. The bracket members 230 are configured to slidably receive a fork element of the fork lift 106 therethrough. The other support members 224, positioned at a distal end 110 (see FIG. 1) from the fork lift 106 includes multiple gliding elements 232. The gliding elements 232 are configured to slide the blade assembly 202 along the work surface 104 while the fork lift 106 drags the packaged assembly 200 outside of the container 102. The gliding elements 232 are wheels. Alternatively, the gliding elements 232 may include rolling pins.

The packaged assembly 200 includes a number of separator blocks 234. The separator blocks 234 are made of wood. Alternatively, the separator blocks 234 may be made of polyesters, cellulose, aluminum, and the like. The separator blocks 234 are placed on the outer surface 216 of the frame member 208. The separator blocks 234 are arranged with lateral spaces therebetween. The separator blocks 234 include a top surface 236 and a bottom surface 237. The bottom surface 237 of the separator blocks 234 are in a contacting relationship with the outer surface 216 of the frame member 208. The top surface 236 of each of the separator blocks 234 includes a number of depressions 238 defined thereon. The push arms 220 of the push arm assembly 204 are arranged perpendicular to the separator blocks 234 such that the push arms 220 are received partly into the depressions 238 of each of the separator blocks 234.

Referring to FIG. 3, the packaged assembly 200 is bundled such that the blade assembly 202, the brace assembly 203 the push arm assembly 204, the support members 222, 224, and the separator blocks 234 are aligned and arranged to form a compact unit that is stored in the horizontal orientation. The bundling is done by means of steel tapes 240. In other embodiments, the bundling of the packaged assembly 200 may be done by metal wires, ropes, asbestos tape and the like. Each of the steel tapes 240 wraps around the packaged assembly 200 such that the tapes extend parallel with respect to the separator blocks 234. The packaged assembly 200 is stored in the inner space 103 of the container 102 and is transported using the fork lift 106.

INDUSTRIAL APPLICABILITY

The present disclosure relates to the packaged assembly 200 for handling of the work implement of the machine. The package assembly 200 includes the blade assembly 202, the brace assembly 203 and the push arm assembly 204. The blade assembly 202 and the push arm assembly 204 are secured by means of steel tapes 240. The packaged assembly 200 also includes the pair of support members 222, 224. The support members 222, 224 have gliding elements 232 on one and bracket members 230 on the other the packaged assembly 200 is horizontally oriented during handling. The support members 222, 224 aids in handling of the packaged assembly 200 by the fork lift 106.

The packaged assembly 200 described herein saves overall space required by the work implement during storing and handling by providing a compact design for storing the push arm assembly 204 on top of the blade assembly 202. The packaged assembly 200 interacts with the fork lift 106 for handling. The packaged assembly 200 does not require any additional machine for handling, thereby reducing operational costs. Total cycle time in handling of the packaged assembly 200 is reduced since the packaged assembly 200 is pre-stored in a stable configuration thereof, which is the horizontal orientation. This prevents the need to re-orient the packaged assembly 200 specifically for storage purposes post transportation thereof. Further, the packaged assembly 200 has less handling overheads and reduced labor intervention since no re-orientation of the packaged assembly 200 is required. The same packaged assembly 200 from a supplier may be utilized for finished product transportation.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A packaged assembly for a work implement, the packaged assembly comprising:

a blade assembly including a blade and a frame member, the frame member having a pair of side plates;

a brace assembly;

a push arm assembly including a plurality of push arms;

a pair of support members coupled to the pair of side plates of the blade assembly, wherein one of the pair of support members includes a plurality of gliding elements attached thereto, the plurality of gliding elements configured to slide the blade assembly along a work surface, wherein the blade assembly is arranged in a manner such that the blade of the blade assembly faces the work surface; and a plurality of separator blocks provided in a laterally spaced part arrangement on an outer surface of the frame member of the blade assembly, the plurality of separator blocks positioned in a contacting relationship with the outer surface, wherein a top surface of each of the plurality of separator blocks includes a plurality of depressions formed thereon, wherein the plurality of push arms of the push arm assembly are received into the plurality of depressions of the plurality of separator blocks, such that the plurality of push arms are arranged perpendicular to the plurality of separator blocks, wherein the packaged assembly is bundled in a manner such that the packaged assembly lies in a horizontal orientation, and wherein the packaged assembly is configured to cooperate and interact with a fork lift, such that the fork lift performs loading and unloading operations of the packaged assembly without re-orienting the packaged assembly.

* * * * *